US011339806B2

(12) United States Patent
Nishimura et al.

(10) Patent No.: US 11,339,806 B2
(45) Date of Patent: May 24, 2022

(54) FLOW CONTROLLER AND DRIVING APPARATUS INCLUDING THE SAME

(71) Applicant: SMC CORPORATION, Chiyoda-ku (JP)

(72) Inventors: Akiho Nishimura, Moriya (JP); Hirosuke Yamada, Tsukubamirai (JP); Kenji Fukushima, Tsukuba (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 17/298,726

(22) PCT Filed: Nov. 28, 2019

(86) PCT No.: PCT/JP2019/046529
§ 371 (c)(1),
(2) Date: Jun. 1, 2021

(87) PCT Pub. No.: WO2020/116301
PCT Pub. Date: Jun. 11, 2020

(65) Prior Publication Data

US 2022/0049720 A1 Feb. 17, 2022

(30) Foreign Application Priority Data

Dec. 3, 2018 (JP) ..... JP2018-226662

(51) Int. Cl.
*F15B 11/044* (2006.01)
*F15B 11/048* (2006.01)
(Continued)

(52) U.S. Cl.
CPC ..... *F15B 11/044* (2013.01); *F15B 11/048* (2013.01); *F15B 13/042* (2013.01);
(Continued)

(58) Field of Classification Search
CPC ... F15B 11/044; F15B 11/0445; F15B 11/048; F15B 21/10; F15B 2211/46
(Continued)

(56) References Cited

U.S. PATENT DOCUMENTS 4,610,193 A * 9/1986 Barker ..... F15B 11/003 91/421
5,214,997 A * 6/1993 Lebret ..... F15B 13/01 91/440
(Continued)

FOREIGN PATENT DOCUMENTS

CA 2 437 849 A1 4/2004
JP 6-85740 U 12/1994
(Continued)

OTHER PUBLICATIONS

Indian Office Action dated Sep. 10, 2021 in Indian Patent Application No. 202147029420, 6 pages.
(Continued)

*Primary Examiner* — Michael Leslie
(74) *Attorney, Agent, or Firm* — Oblon, McClelland, Maier & Neustadt, L.L.P.

(57) ABSTRACT

A flow controller that changes the flow rate of air exhausted from an air cylinder in mid-stroke includes a first switching valve displaced from a first position to a second position under the effect of pilot air, and causing one port of the air cylinder to communicate with a first channel at the first position, exhausting air exhausted from the one port of the air cylinder while reducing the flow rate of the air using a first regulating valve at the second position. Since the pilot air is taken into the first switching valve from a second channel in a system different from the system of the first
(Continued)

channel, a second regulating valve can be adjusted without being affected by the degree of opening of the first regulating valve.

11 Claims, 10 Drawing Sheets

(51) Int. Cl.
*F15B 13/042* (2006.01)
*F15B 21/10* (2006.01)

(52) U.S. Cl.
CPC ..... *F15B 21/10* (2013.01); *F15B 2211/329* (2013.01); *F15B 2211/355* (2013.01); *F15B 2211/40515* (2013.01); *F15B 2211/40576* (2013.01); *F15B 2211/40584* (2013.01); *F15B 2211/411* (2013.01); *F15B 2211/41536* (2013.01); *F15B 2211/41581* (2013.01); *F15B 2211/428* (2013.01); *F15B 2211/46* (2013.01); *F15B 2211/575* (2013.01); *F15B 2211/6355* (2013.01); *F15B 2211/67* (2013.01); *F15B 2211/7053* (2013.01); *F15B 2211/75* (2013.01); *F15B 2211/8855* (2013.01)

(58) Field of Classification Search
USPC ..... 91/420, 449, 450
See application file for complete search history.

(56) References Cited

U.S. PATENT DOCUMENTS

| | | | | |
|---|---|---|---|---|
| 6,848,641 | B2 * | 2/2005 | Lohmann | F15B 11/003 242/129 |
| 7,430,953 | B2 * | 10/2008 | Bitter | B66F 9/0655 91/437 |
| 10,247,208 | B2 * | 4/2019 | Hama | F15B 11/048 |
| 10,344,783 | B2 * | 7/2019 | Wang | E04G 21/0454 |

FOREIGN PATENT DOCUMENTS

| | | | | |
|---|---|---|---|---|
| JP | 5578502 | B2 | 8/2014 | |
| JP | 2016-161055 | A | 9/2016 | |
| WO | WO-2020095775 | A1 * | 5/2020 | F15B 11/04 |

OTHER PUBLICATIONS

Office Action dated Jun. 8, 2021 in corresponding Japanese Patent Application No. 2018-226662 (with English Translation), 8 pages.
International Search Report and Written Opinion dated Feb. 18, 2020 in PCT/JP2019/046529 filed on Nov. 28, 2019.

* cited by examiner

10

10

FLOW CONTROLLER AND DRIVING APPARATUS INCLUDING THE SAME

TECHNICAL FIELD

The present invention relates to a flow controller capable of changing the operating speed of an air cylinder in mid-stroke and a driving apparatus including the same.

BACKGROUND ART

In a case where a shock absorber cannot be attached to a cylinder or where the speed of the cylinder needs to be changed at a position other than the stroke ends, a speed controller (flow controller) capable of changing the speed in mid-stroke using an air circuit has been used (see Japanese Patent No. 5578502).

The speed controller described in Japanese Patent No. 5578502 includes a three-way shuttle valve on a channel between a high-pressure air supply source and an air cylinder to guide exhaust air from the air cylinder to an exhaust channel different from the channel for introducing high-pressure air. The exhaust air is exhausted via a switching valve and a first throttle valve provided for the exhaust channel and a second throttle valve. The switching valve switches the channels when the piston is in the vicinity of the stroke ends such that the exhaust air passes through the first throttle valve reducing the stroke speed to reduce impact on the air cylinder during an exhausting process.

SUMMARY OF INVENTION

To operate the known flow controller properly, it is necessary to match three adjustment processes with one another, i.e., adjustment of a regulating needle (throttle valve) that regulates operation timing of the switching valve, adjustment of the first throttle valve, and adjustment of the second throttle valve.

However, since the three adjustment processes affect each other, that is, one adjustment result affects the other two adjustment processes, the above-described speed controller cannot be easily adjusted.

Thus, the present invention has the object of providing an easily adjustable flow controller and a driving apparatus including the same.

According to one aspect of the present invention, a flow controller that changes a flow rate of air supplied or exhausted through at least one of a first channel communicating with one port of an air cylinder and a second channel communicating with another port of the air cylinder in mid-stroke, comprises a first switching valve configured to be displaced from a first position to a second position under an effect of pilot air, cause the one port of the air cylinder to communicate with the first channel at the first position, and cause the one port of the air cylinder to communicate with an air outlet via a first regulating valve at the second position, a first introduction path configured to guide the pilot air from the second channel to the first switching valve, and a second regulating valve provided for the first introduction path and configured to adjust timing of displacement of the first switching valve by regulating a flow rate of the pilot air.

According to another aspect of the present invention, a driving apparatus comprises the flow controller according to the one aspect, a high-pressure air supply source configured to supply high-pressure air to the air cylinder via the first channel or the second channel, and an air outlet configured to exhaust air from the air cylinder via the first channel or the second channel.

In accordance with the flow controller and the driving apparatus according to the above-described aspects, the pilot air is taken into the first switching valve from the second channel in a different system that does not communicate with the first regulating valve connected to the first switching valve. Thus, a throttle valve that regulates switching timing can be easily adjusted without being affected by the adjustment state of the first regulating valve.

The above and other objects, features, and advantages of the present invention will become more apparent from the following description when taken in conjunction with the accompanying drawings in which a preferred embodiment of the present invention is shown by way of illustrative example.

DESCRIPTION OF EMBODIMENTS

A preferred embodiment according to the present invention will be described in detail below with reference to the accompanying drawings.

Figure 1:
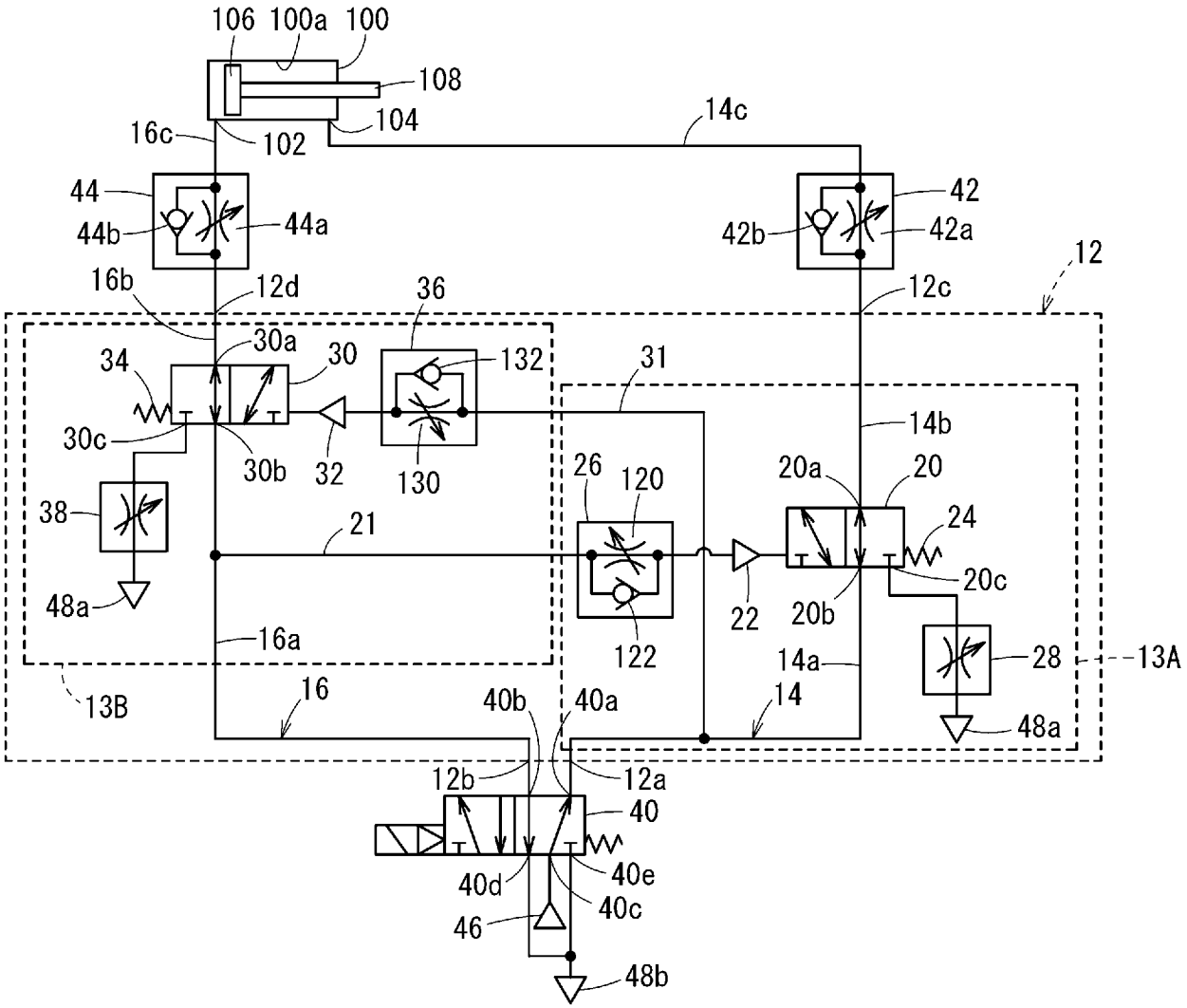
FIG. 1 is a fluid circuit diagram of a flow controller and a driving apparatus according to an embodiment.

As illustrated in FIG. 1, a driving apparatus 10 according to an embodiment is used to drive an air cylinder 100 and includes a first channel 14 connected to one end of the air cylinder 100 and a second channel 16 connected to another end. The driving apparatus 10 further includes a flow controller 12, a high-pressure air supply source 46, air outlets 48*a* and 48*b*, an operation switching valve 40, and speed controllers 42 and 44.

The air cylinder 100 is a double-acting cylinder used for, for example, automated equipment and production lines, and includes a piston 106 partitioning a cylinder chamber 100*a* and a piston rod 108 connected to the piston 106. A pressure chamber adjacent to the head of the piston 106 has a head-side port 102. Moreover, a pressure chamber adjacent to the rod of the piston 106 has a rod-side port 104. The second channel 16 is connected to the head-side port 102, and the first channel 14 is connected to the rod-side port 104.

The first channel 14 is an air channel extending from the operation switching valve 40 to the rod-side port 104 of the air cylinder 100. Moreover, the second channel 16 is an air channel extending from the operation switching valve 40 to the head-side port 102 of the air cylinder 100. Introduction of high-pressure air into the air cylinder 100 and exhaust of air inside the air cylinder 100 are performed via the first channel 14 and the second channel 16. The piston rod 108 is pushed out by high-pressure air introduced via the second channel 16 (working process). Moreover, the piston rod 108 is drawn in by high-pressure air introduced via the first channel 14 (retracting process).

The flow controller 12 is connected to the first channel 14 and the second channel 16 to change the operating speed of the air cylinder 100 in mid-stroke. The flow controller 12 includes a first cylinder port 12*c* and a second cylinder port 12*d* to which pipes from the air cylinder 100 are connected and a first connection port 12*a* and a second connection port 12*b* to which pipes from the operation switching valve 40 are connected. The flow controller 12 further includes a first flow rate adjustment section 13A controlling the flow rate in the first channel 14 and a second flow rate adjustment section 13B controlling the flow rate in the second channel 16.

The first flow rate adjustment section 13A of the flow controller 12 includes a first switching valve 20, a first regulating valve 28, and a second regulating valve 26. The first switching valve 20 is a three-way valve including first connection portions 20*a*, second connection portions 20*b*, and third connection portions 20*c*. The first switching valve 20 is displaced from a first position to a second position by pilot air supplied via the second regulating valve 26. That is, the first switching valve 20 is driven by a drive piston 22 driven in response to the pilot air and a biasing member 24 returning the first switching valve 20 to the first position. A specific structure of the first switching valve 20 will be described later with reference to FIG. 3. The first connection portions 20*a* communicate with the first cylinder port 12*c* via a channel 14*b*, the second connection portions 20*b* communicate with the first connection port 12*a* via a channel 14*a*, and the third connection portions 20*c* communicates with one of the air outlets 48*a* via the first regulating valve 28.

Figure 8:
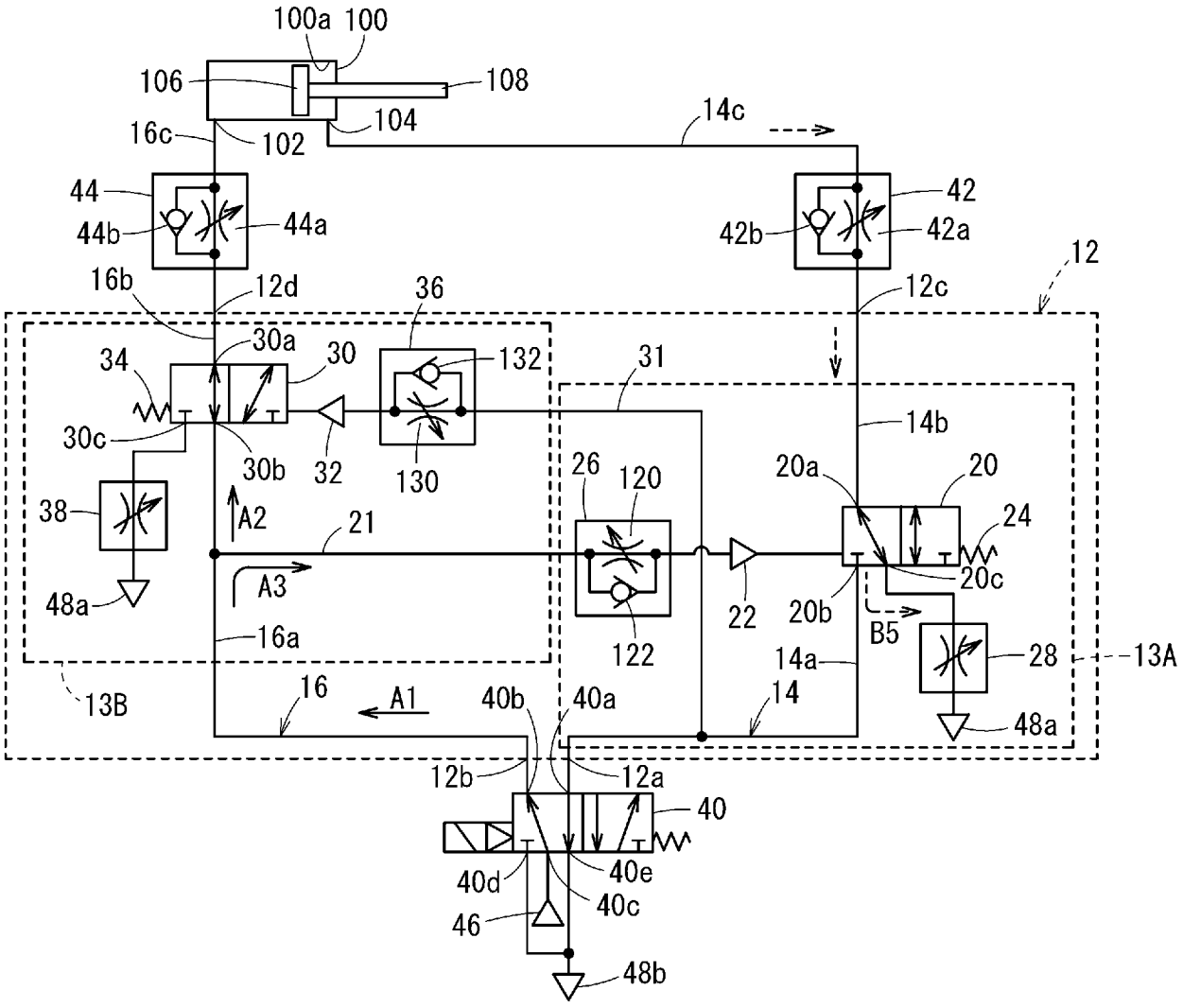
FIG. 8 is a fluid circuit diagram illustrating a connection state after the first switching valve moves to the second position during the working process in FIG. 5.

When the first switching valve 20 is at the first position, the first connection portions 20*a* and the second connection portions 20*b* are connected to each other, and thereby the first cylinder port 12*c* and the first connection port 12*a* communicate with each other. Moreover, when the first switching valve 20 is at the second position (see FIG. 8), the first connection portions 20*a* and the third connection portions 20*c* are connected to each other, and thereby the first cylinder port 12*c* and the first regulating valve 28 (and the air outlet 48*a*) communicate with each other.

The first regulating valve 28 is configured by an variable throttle valve capable of varying a flow rate, and is configured to regulate the operating speed of the air cylinder 100 to a second speed by reducing the flow rate of air flowing from the third connection portions 20*c* to the air outlet 48*a*. The first regulating valve 28 is not limited to the variable throttle valve but may be a fixed throttle valve allowing air to pass through the throttle valve at a fixed flow rate.

The second regulating valve 26 is disposed on a first introduction path 21. One end of the first introduction path 21 is connected to a channel 16*a* (second channel 16) between a second switching valve 30 and the operation switching valve 40, and another end of the first introduction path 21 is connected to the drive piston 22 of the first switching valve 20. The first introduction path 21 introduces pilot air from the second channel 16 into the first switching valve 20. The second regulating valve 26 includes a throttle valve 120 capable of varying a flow rate and a check valve 122 connected in parallel to the throttle valve 120. The throttle valve 120 is configured to reduce the flow rate of pilot air flowing from the second channel 16 to the drive piston 22 of the first switching valve 20. The check valve 122 is disposed in a direction to allow the passage of air flowing from the drive piston 22 to the second channel 16. The check valve 122 is configured to exhaust the pilot air remaining in the drive piston 22 to the second channel 16 when the pressure in the second channel 16 decreases, so that the first switching valve 20 smoothly returns to the initial position.

The second flow rate adjustment section 13B of the flow controller 12 includes the second switching valve 30, a third regulating valve 38, and a fourth regulating valve 36. The second switching valve 30 is a three-way valve including a first connection portion 30*a*, a second connection portion 30*b*, and a third connection portion 30*c*, and is displaced from a first position to a second position by pilot air supplied via the fourth regulating valve 36. That is, the second switching valve 30 is driven by a drive piston 32 driven in response to the pilot air and a biasing member 34 returning the second switching valve 30 to the first position. The specific structure of the second switching valve 30 is similar to that of the first switching valve 20. The first connection portion 30*a* communicates with the second cylinder port 12*d* via a channel 16*b*, the second connection portion 30*b* communicates with the second connection port 12*b* via the channel 16*a*, and the third connection portion 30*c* communicates with the other of the air outlets 48*a* via the third regulating valve 38.

When the second switching valve 30 is at the first position, the first connection portion 30*a* and the second connection portion 30*b* are connected to each other, and thereby the second cylinder port 12*d* and the second connection port 12*b* communicate with each other. Moreover, when the second switching valve 30 is at the second position (see FIG. 10), the first connection portion 30*a* and the third connection portion 30*c* are connected to each other, and thereby the second cylinder port 12*d* and the third regulating valve 38 communicate with each other.

The third regulating valve 38 comprises an variable throttle valve capable of varying a flow rate, and is configured to regulate the operating speed of the air cylinder 100 to a fourth speed by reducing the flow rate of air flowing from the third connection portion 30*c* to the air outlet 48*a*. The third regulating valve 38 is not limited to the variable throttle valve but may be a fixed throttle valve allowing air to pass through the throttle valve at a fixed flow rate.

The fourth regulating valve 36 is disposed on a second introduction path 31. One end of the second introduction path 31 is connected to the channel 14*a* (first channel 14) between the first switching valve 20 and the operation switching valve 40, and another end of the second introduction path 31 is connected to the drive piston 32 of the second switching valve 30. The second introduction path 31 introduces pilot air from the first channel 14 into the second switching valve 30. The fourth regulating valve 36 includes a throttle valve 130 capable of varying a flow rate and a check valve 132 connected in parallel to the throttle valve 130. The throttle valve 130 is configured to reduce the flow rate of pilot air flowing from the first channel 14 to the drive piston 32 of the second switching valve 30. The check valve 132 is disposed to face a direction allowing the passage of air flowing from the drive piston 32 to the first channel 14. The check valve 132 is configured to exhaust the pilot air remaining in the drive piston 32 to the first channel 14 when the pressure in the first channel 14 decreases so that the second switching valve 30 smoothly returns to the initial position. The first regulating valve 28, the second regulating valve 26, the third regulating valve 38, and the fourth regulating valve 36 may be commercially available needle valves with a reverse flow check valve.

The speed controller 42 is disposed on a pipe 14*c* connecting the first cylinder port 12*c* of the flow controller 12 and the rod-side port 104 of the air cylinder 100 to each other. The speed controller 42 includes a throttle valve 42*a* capable of varying a flow rate and a check valve 42*b* connected in parallel to the throttle valve 42*a*. The check valve 42*b* is connected in a direction allowing the passage of air flowing from the first cylinder port 12*c* to the rod-side port 104 and checking air flowing in the opposite direction. That is, the speed controller 42 is a meter-out speed controller regulating the speed of the stroke of the air cylinder 100 to a first speed by reducing the flow rate of air exhausted from the rod-side port 104 of the air cylinder 100.

The speed controller 44 is disposed on a pipe 16*c* connecting the second cylinder port 12*d* of the flow controller 12 and the head-side port 102 of the air cylinder 100 to each other. The speed controller 44 includes a throttle valve 44*a* capable of varying a flow rate and a check valve 44*b* connected in parallel to the throttle valve 44*a*. The check valve 44*b* is connected in a direction allowing the passage of air flowing from the second cylinder port 12*d* to the head-side port 102 and checking air flowing in the opposite direction. That is, the speed controller 44 is a meter-out speed controller regulating the operating speed of the air cylinder 100 during the normal stroke to a third speed by reducing the flow rate of air exhausted from the head-side port 102 of the air cylinder 100.

To regulate the operating speed of the air cylinder 100 using the flow rate of the air that flows in (meter-in speed control), each of the speed controllers 42 and 44 and the check valves 42*b* and 44*b* may be disposed to face the opposite direction. Moreover, the speed controllers 42 and 44 are not necessarily disposed on the pipes 14*c* and 16*c*, respectively, and may be disposed at any positions on the first channel 14 and second channel 16, respectively.

The operation switching valve 40 is configured to connect the high-pressure air supply source 46 to one of the first channel 14 and the second channel 16 while connecting the air outlet 48*b* to the other, and vice versa by switching the connections. The operation switching valve 40 is a 5-port, 2-position solenoid valve operated based on a predetermined drive signal. The operation switching valve 40 includes a first port 40*a*, a second port 40*b*, a third port 40*c*, a fourth port 40*d*, and a fifth port 40*e*. When the operation switching valve 40 is at a first position, the first port 40*a* is connected to the third port 40*c*, and the second port 40*b* is connected to the fourth port 40*d*. Moreover, when the operation switching valve 40 is at a second position (see FIG. 8), the first port 40*a* is connected to the fifth port 40*e*, and the second port 40*b* is connected to the third port 40*c*.

The first port 40*a* of the operation switching valve 40 communicates with the first connection port 12*a* of the flow controller 12 via pipes, and the second port 40*b* communicates with the second connection port 12*b* of the flow controller 12 via pipes. Moreover, the third port 40*c* of the operation switching valve 40 communicates with the high-pressure air supply source 46 via pipes, and the fourth port 40*d* and the fifth port 40*e* communicate with the air outlet 48*b*.

That is, when the operation switching valve 40 is at the first position, the operation switching valve 40 causes the high-pressure air supply source 46 to communicate with the first connection port 12*a* to supply high-pressure air to the first channel 14, and causes the air outlet 48*b* to communicate with the second connection port 12*b* to expose the second channel 16 to the atmosphere. Moreover, when the operation switching valve 40 is at the second position, the operation switching valve 40 causes the air outlet 48*b* to communicate with the first connection port 12*a* to expose the first channel 14 to the atmosphere, and causes the high-pressure air supply source 46 to communicate with the second connection port 12*b* to supply high-pressure air to the second channel 16.

The fluid circuit of the driving apparatus 10 according to this embodiment is configured as above. A specific example of the structure of the flow controller 12 will now be described.

Figure 2B:
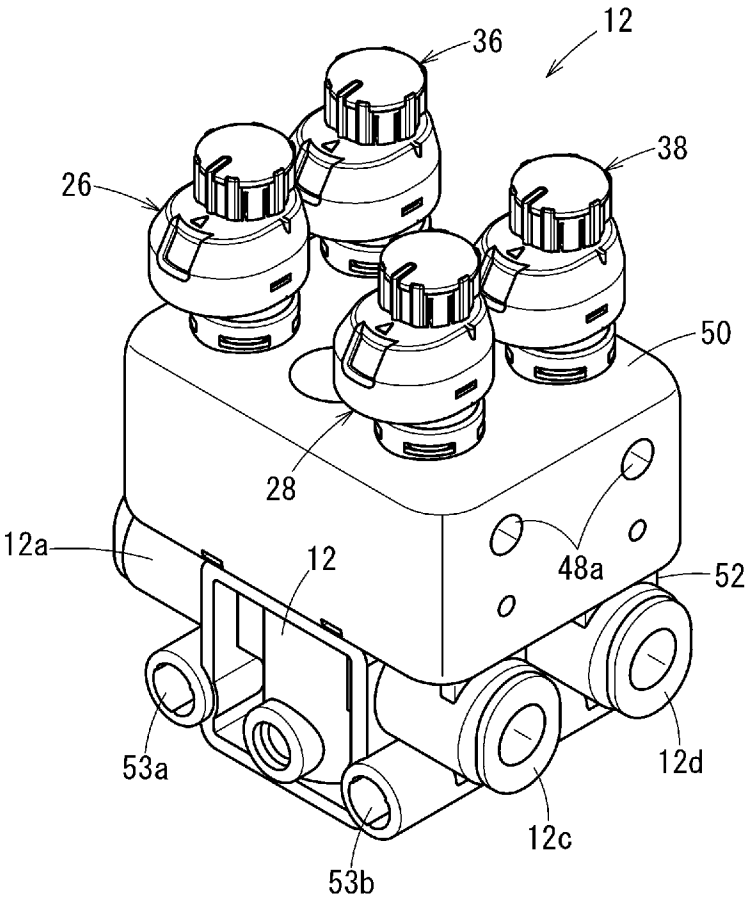
FIG. 2B is a perspective view of the flow controller in FIG. 1 viewed from a side on which cylinder ports lie.

As illustrated in FIG. 2B, the flow controller 12 of this embodiment is configured as a module part including an upper housing 50 and a lower housing 52. The lower housing 52 is provided with the first connection port 12*a*, the second connection port 12*b* (see FIG. 2A), the first cylinder port 12*c*, and the second cylinder port 12*d*. Moreover, the upper housing 50 and the lower housing 52 include therein members constituting the first flow rate adjustment section 13A (see FIG. 1) and the second flow rate adjustment section 13B (see FIG. 1).

Figure 2A:
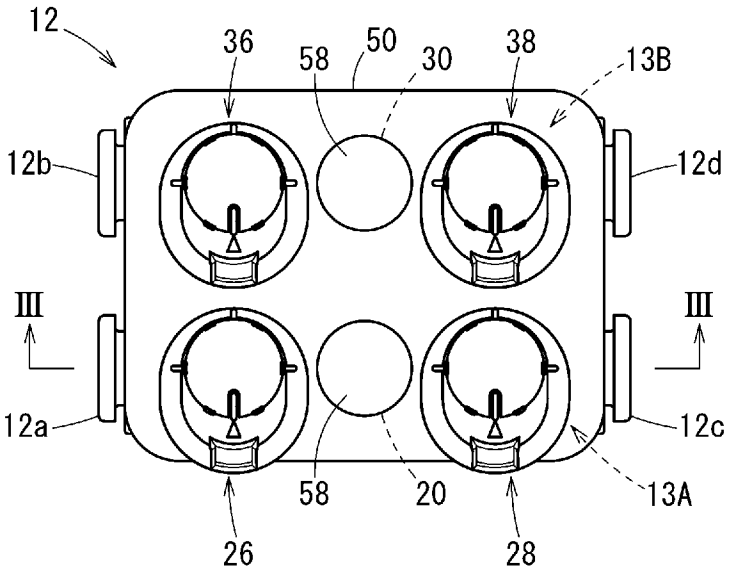
FIG. 2A is a plan view of housings of the flow controller in FIG. 1.

As illustrated in FIG. 2A, the upper housing 50 has a rectangular shape when viewed in plan, and adjustment portions of the first regulating valve 28, the second regulating valve 26, the third regulating valve 38, and the fourth regulating valve 36 protrude from the top surface of the upper housing 50. The first flow rate adjustment section 13A extends along a line connecting the first connection port 12*a* and the first cylinder port 12*c*, and the second flow rate adjustment section 13B extends along a line connecting the second connection port 12*b* and the second cylinder port 12*d*. The first regulating valve 28 of the first flow rate adjustment section 13A is disposed adjacent to the first cylinder port 12*c*, and the second regulating valve 26 of the first flow rate adjustment section 13A is disposed adjacent to the first connection port 12*a*. The first switching valve 20 is disposed between the first regulating valve 28 and the second regulating valve 26. Moreover, the third regulating valve 38 of the second flow rate adjustment section 13B is disposed adjacent to the second cylinder port 12*d*, and the fourth regulating valve 36 of the second flow rate adjustment section 13B is disposed adjacent to the second connection port 12*b*. The second switching valve 30 is disposed between the third regulating valve 38 and the fourth regulating valve 36.

As illustrated in FIG. 2B, the air outlets 48*a* are created in a side surface of the upper housing 50 adjacent to the cylinder ports. Moreover, the lower housing 52 is provided with fixing holes 53*a* and 53*b* used for securing the flow controller 12 to a supporting member (not illustrated).

The internal structure of the first flow rate adjustment section 13A of the flow controller 12 will now be described with reference to FIG. 3. As the internal structure of the second flow rate adjustment section 13B is similar to that of the first flow rate adjustment section 13A illustrated in FIG. 3, the description thereof will be omitted.

Figure 3:
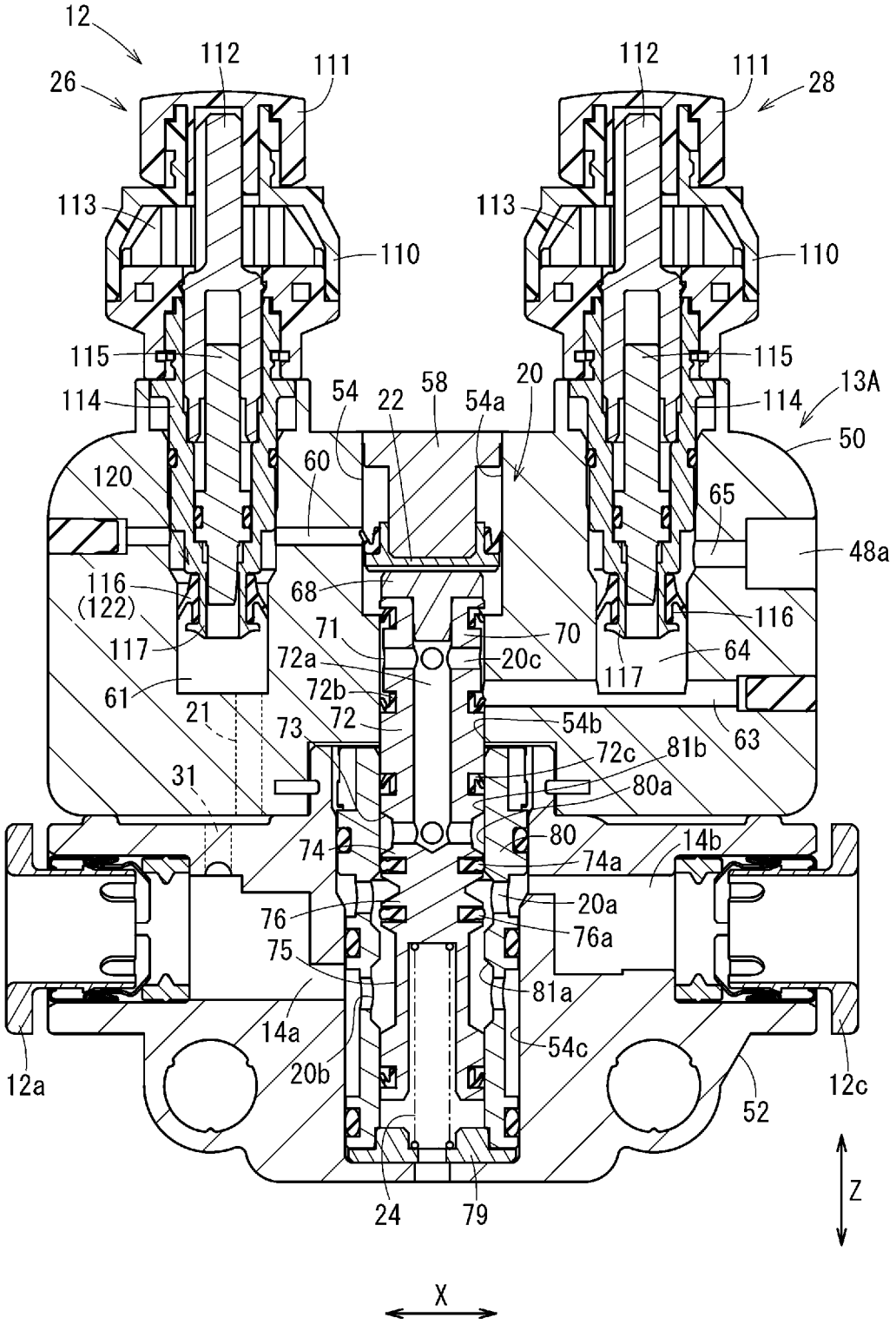
FIG. 3 is a cross-sectional view taken along line III-III in FIG. 2A when a first switching valve is at a first position.

As illustrated in FIG. 3, in the flow controller 12, the lower housing 52 and the upper housing 50 are joined to each other such that the upper housing 50 is stacked on top of the lower housing 52. The upper housing 50 has a first mounting hole 64 for installing the first regulating valve 28, a second mounting hole 61 for installing the second regulating valve 26, and a third mounting hole 54 for accommodating the first switching valve 20. The first mounting hole 64, the second mounting hole 61, and the third mounting hole 54 extend in the height direction of the upper housing 50 (direction of an arrow Z), and each have an opening in the upper end of the upper housing 50. The third mounting hole 54 passes through the upper housing 50 and extends further in the lower housing 52. The first mounting hole 64 and the second mounting hole 61 are separated from each other in a direction of an arrow X illustrated in FIG. 3, and the third mounting hole 54 is disposed between the first mounting hole 64 and the second mounting hole 61.

The first mounting hole 64 has a diameter large enough to accommodate the first regulating valve 28, and accommodates the first regulating valve 28 inserted from the opening in the upper surface of the upper housing 50. A lower end part of the first mounting hole 64 has an opening of a first air outlet 63. The first air outlet 63 extends toward the third mounting hole 54 and communicates with a spool sliding portion 54*b* of the third mounting hole 54 at the third connection portions 20*c*. Moreover, a side part of the first mounting hole 64 has an opening of a second air outlet 65. The first mounting hole 64 communicates with the air outlet 48*a* via the second air outlet 65.

The first regulating valve 28 is configured by a needle valve with a check valve 116, and includes a needle 115 and a tubular portion 117 in which the needle 115 is fitted. The check valve 116 is provided for an outer circumferential part of the tubular portion 117. The check valve 116 and the tubular portion 117 are disposed between the first air outlet 63 and the second air outlet 65. The check valve 116 is configured to check air flowing upward in the first mounting hole 64 and to allow the passage of air flowing downward. That is, the air flowing downward in the first mounting hole 64 passes through the check valve 116 while the flow rate of air flowing in the opposite direction is regulated by the needle valve. The needle valve is configured to control the flow rate of air when the channel is narrowed by the needle 115 moving downward and fitted in the tubular portion 117, and is configured to increase the flow rate of air when the channel between the needle 115 and the tubular portion 117 is widened by the needle 115 moving upward.

The first regulating valve 28 further includes a needle holding portion 114 accommodating the needle 115 such that the needle 115 can move vertically, a control knob 111, a link portion 112 transferring the rotational force of the control knob 111 to the needle 115, a graduated portion 113 indicating the position of the needle 115, and a case body 110 covering the link portion 112 and the graduated portion 113. The needle holding portion 114 moves the needle 115 vertically through a screw mechanism. A lower end part of the link portion 112 is linked with the needle 115, and an upper end part of the link portion 112 is linked with the control knob 111. The link portion 112 rotates in an integrated manner with the control knob 111 to transfer the rotational force of the control knob 111 to the needle 115. The graduated portion 113 is a member linked with an outer circumferential part of the link portion 112. The graduated portion 113 indicates the degree of opening of the needle 115 and is joined to the outer circumferential part of the link portion 112.

Figure 4:
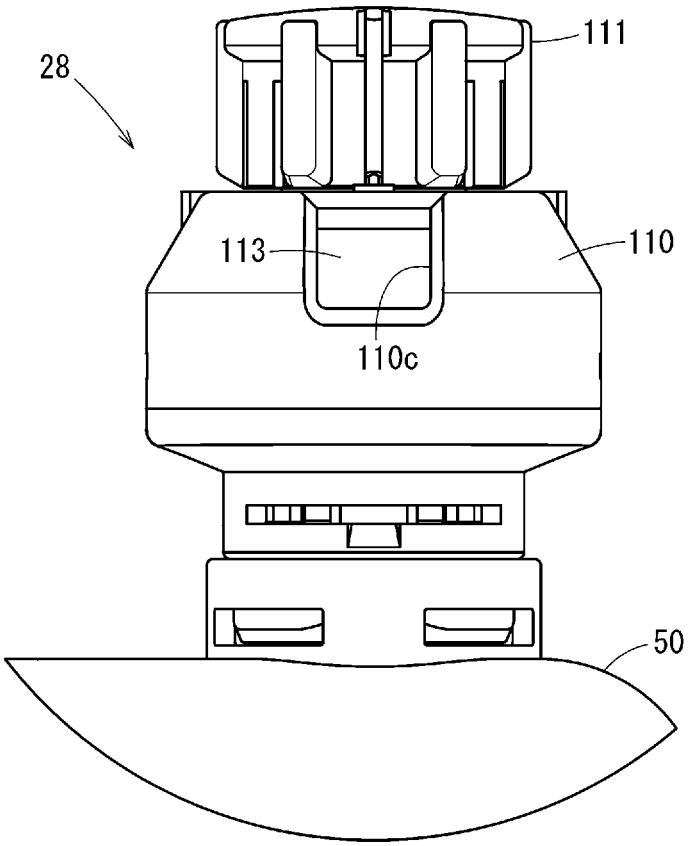
FIG. 4 is an enlarged view of a graduated portion of a first regulating valve in FIG. 2B.

The graduated portion 113 and the link portion 112 are covered with the case body 110. As illustrated in FIG. 4, a U-shaped window portion 110*c* is formed by partially cutting off an outer circumferential part of the case body 110, and the markings of the graduated portion 113 can be visually checked through the window portion 110*c*.

As illustrated in FIG. 3, the second mounting hole 61 has a diameter large enough to accommodate the second regulating valve 26. A lower end part of the second mounting hole 61 has an opening of the first introduction path 21. The first introduction path 21 extends downward to the back of the drawing sheet to communicate with the second channel 16. Moreover, a pilot air channel 60 extends from a side part of the second mounting hole 61 in the X direction to communicate with a piston chamber 54*a* of the third mounting hole 54.

The second regulating valve 26 is comprised of a needle valve with the check valve 116 having a similar structure as the first regulating valve 28. In the second regulating valve 26, the same reference numerals and symbols are used for components similar to those in the first regulating valve 28, and the detailed descriptions will be omitted. The check valve 116 and the needle valve of the second regulating valve 26 are disposed between the first introduction path 21 and the pilot air channel 60 of the second mounting hole 61. In the second regulating valve 26, the check valve 116 constitutes the check valve 122 in FIG. 1 checking air flowing from the first introduction path 21 to the pilot air channel 60 and allowing the passage of air flowing in the opposite direction.

The third mounting hole 54 in FIG. 3 includes the piston chamber 54*a* and the spool sliding portion 54*b* provided for the upper housing 50 and a spool accommodating hole 54*c* provided for the lower housing 52. The piston chamber 54*a*, the spool sliding portion 54*b*, and the spool accommodating hole 54*c* are arranged in this order from top to bottom. The piston chamber 54*a* is an empty room having an inner diameter larger than an outer diameter of a spool 70 (described later), and an upper end part of the piston chamber 54*a* is sealed with an end cap 58. Moreover, a side part of the piston chamber 54*a* has an opening of the pilot air channel 60. The drive piston 22 is disposed in the piston chamber 54*a* between the pilot air channel 60 and the spool sliding portion 54*b*. The drive piston 22 airtightly partitions the piston chamber 54*a* into an area communicating with the pilot air channel 60 and an area adjacent to the spool sliding portion 54*b*. The drive piston 22 is configured to be displaced downward by the pressure of pilot air flowing from the pilot air channel 60.

The spool sliding portion 54*b* has an inner diameter substantially identical to the outer diameter of the spool 70, and the spool 70 is disposed inside of the spool sliding portion 54*b*. The spool 70 is disposed inside the spool sliding portion 54*b* and the spool accommodating hole 54*c*.

The spool accommodating hole 54*c* is an empty room with a substantially columnar shape, and a lower end part of the spool accommodating hole 54*c* is sealed with an end member 79. The spool accommodating hole 54*c* has an inner diameter larger than the outer diameter of the spool 70, and a spool guide 80 is installed inside of the spool accommodating hole 54*c*. The spool guide 80 is a substantially cylindrical member having a slide hole 80*a* with an inner diameter substantially identical to the diameter of the spool 70, and the spool 70 is fitted in the slide hole 80*a*. The biasing member 24 such as a coil spring is disposed at the end member 79 of the spool accommodating hole 54*c*. The biasing member 24 is in contact with a lower end part of the spool 70 and biases the spool 70 toward the end cap 58.

A side part of the spool accommodating hole 54*c* has an opening of the channel 14*a* extending from the first connection port 12*a*. The spool guide 80 includes the second connection portions 20*b* radially passing through the spool guide 80 in the vicinity of the channel 14*a*. The interior of the spool guide 80 communicates with the channel 14*a* via the second connection portions 20*b*. Moreover, a side part of the spool accommodating hole 54*c* above the channel 14*a* has an opening of the channel 14*b* extending from the first cylinder port 12*c*. The spool guide 80 includes the first connection portions 20*a* radially passing through the spool guide 80 in the vicinity of the channel 14*b*. The interior of the spool guide 80 communicates with the channel 14*b* via the first connection portions 20*a*.

Moreover, the spool guide 80 includes a first narrowed portion 81*a* formed between the first connection portions 20*a* and the second connection portions 20*b* and a second narrowed portion 81*b* disposed between the first connection portions 20*a* and the third connection portions 20*c*. When the spool 70 is biased by the biasing member 24 and disposed at a first position, the second narrowed portion 81*b* is in firm contact with a first partition wall 74 of the spool 70 to airtightly isolate the first connection portions 20*a* and the third connection portions 20*c* from each other. Moreover, when the spool 70 is pushed by the drive piston 22 and displaced downward to a second position (see FIG. 7), the first narrowed portion 81*a* comes into firm contact with a second partition wall 76 of the spool 70 to airtightly isolate the first connection portions 20*a* and the second connection portions 20*b* from each other.

The spool 70 has a first recess 71, a second recess 73, and a third recess 75 created in outer circumferential parts of the spool 70 from top to bottom. Moreover, the spool 70 has an intra-spool channel 72*a* inside of the spool 70 to cause the first recess 71 and the second recess 73 to communicate with each other. The first recess 71 is created at a position to communicate with the first air outlet 63 when the spool 70 is at the second position. The second recess 73 is created at a position to communicate with the first connection portions 20*a* when the spool 70 is at the second position. The intra-spool channel 72*a* extends along the central axis of the spool 70 in the axial direction, and the upper end of the intra-spool channel 72*a* is sealed with a sealing portion 68. The upper end of the intra-spool channel 72*a* communicates with the first recess 71 through holes radially passing through the spool 70 at the position of the first recess 71, and the lower end of the intra-spool channel 72*a* communicates with the second recess 73 through holes radially passing through the spool 70 at the position of the second recess 73. That is, when the spool 70 is at the second position, the first connection portions 20*a* and the first air outlet 63 communicate with each other via the first recess 71, the intra-spool channel 72*a*, and the second recess 73.

The third recess 75 is longer than the first narrowed portion 81*a* in the axial direction, and is created at a position to communicate with the first connection portions 20*a* and the second connection portions 20*b* when the spool 70 is at the first position. That is, the third recess 75 causes the first connection portions 20*a* and the second connection portions 20*b* to communicate with each other when the spool 70 is at the first position. When the spool 70 is at the second position, the third recess 75 communicates only with the second connection portions 20*b*.

A sliding portion 72 having an outer diameter substantially identical to the diameter of the spool sliding portion 54*b* is formed between the first recess 71 and the second recess 73 of the spool 70, and packings 72*b* and 72*c* are disposed on outer circumferential parts of the sliding portion 72. The packings 72*b* and 72*c* prevent air from leaking along the outer circumferential parts of the sliding portion 72.

Moreover, the first partition wall 74 and the second partition wall 76 are formed between the second recess 73 and the third recess 75. A packing 74*a* is attached to the first partition wall 74. When the spool 70 is at the first position, the first partition wall 74 is located at the second narrowed portion 81*b*, and the packing 74*a* is in firm contact with the second narrowed portion 81*b* to airtightly isolate the second recess 73 and the first connection portions 20*a* from each other. Moreover, when the spool 70 is at the second position, the first partition wall 74 is separated from the second narrowed portion 81*b*, and the second recess 73 and the first connection portions 20*a* communicate with each other. Moreover, a packing 76*a* is attached to the second partition wall 76. The second partition wall 76 is formed below the first partition wall 74 and is separated from the first narrowed portion 81*a* when the spool 70 is at the first position. When the spool 70 is at the second position, the second partition wall 76 is located inside the first narrowed portion 81*a*, and the packing 76*a* is in firm contact with the first narrowed portion 81*a* to airtightly isolate the first connection portions 20*a* and the second connection portions 20*b* from each other.

The first connection port 12*a* is disposed in one side part of the lower housing 52 and communicates with the second connection portions 20*b* via the channel 14*a*. Moreover, the channel 14*a* has an opening of one end of the second introduction path 31, and the second introduction path 31 extends to the fourth regulating valve 36 in the second flow rate adjustment section 13B. A pipe from the operation switching valve 40 is connected to the first connection port 12*a*.

The first cylinder port 12*c* is disposed in another side part of the lower housing 52 and communicates with the first connection portions 20*a* via the channel 14*b*. The pipe 14*c* extending from the rod-side port 104 of the air cylinder 100 is connected to the first cylinder port 12*c*.

The flow controller 12 and the driving apparatus 10 according to this embodiment are configured as above. Operations thereof will now be described.

Figure 5:
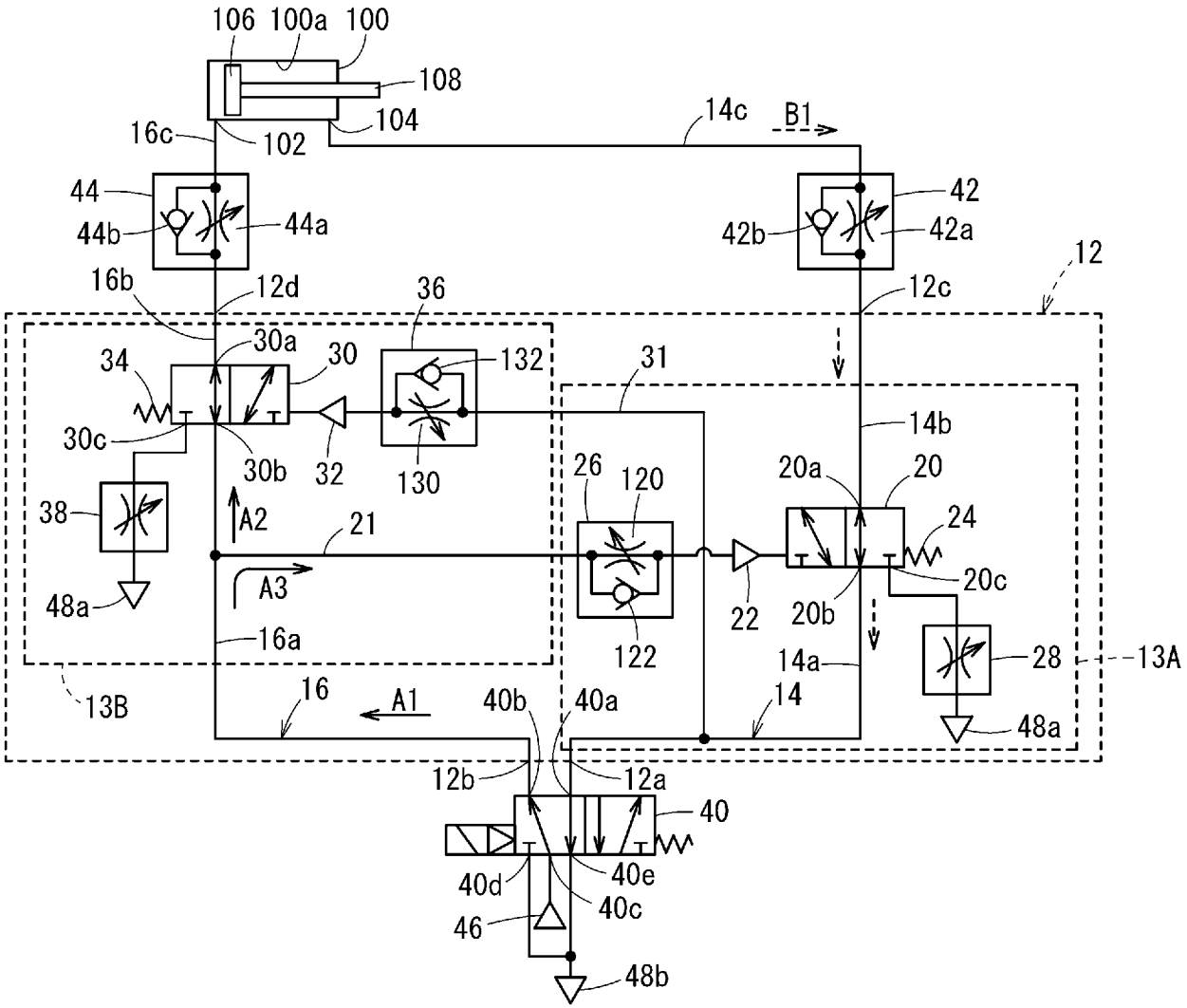
FIG. 5 is a fluid circuit diagram illustrating a connection state of the flow controller and the driving apparatus in FIG. 1 during a working process of an air cylinder.

As illustrated in FIG. 5, during the working process where the piston rod 108 of the air cylinder 100 is pushed out, the operation switching valve 40 is displaced to the second position. This causes the high-pressure air supply source 46 to be connected to the second channel 16 and the air outlet 48*b* to be connected to the first channel 14. The first switching valve 20 and the second switching valve 30 are respectively biased by the biasing members 24 and 34 to the first positions. The high-pressure air in the second channel 16 flows in the channel 16*a* of the flow controller 12 as indicated by arrows A1 and A2. The high-pressure air then flows into the cylinder chamber 100*a* of the air cylinder 100 via the second connection portion 30*b* and the first connection portion 30*a* of the second switching valve 30. The speed controller 44 on the pipe 16*c* of the second channel 16 allows the passage of air flowing to the air cylinder 100 without regulating the flow rate of the air.

The air in the rod-side part of the cylinder chamber 100*a* of the air cylinder 100 is exhausted from the rod-side port 104 as the piston 106 moves. The air exhausted from the air cylinder 100 is exhausted from the air outlet 48*b* via the speed controller 42 and the first switching valve 20 provided for the first channel 14. Since the meter-out speed controller 42 regulates the flow rate of air exhausted from the air cylinder 100, the piston rod 108 operates at a drive speed (first speed) according to the degree of opening of the speed controller 42.

Figure 6:
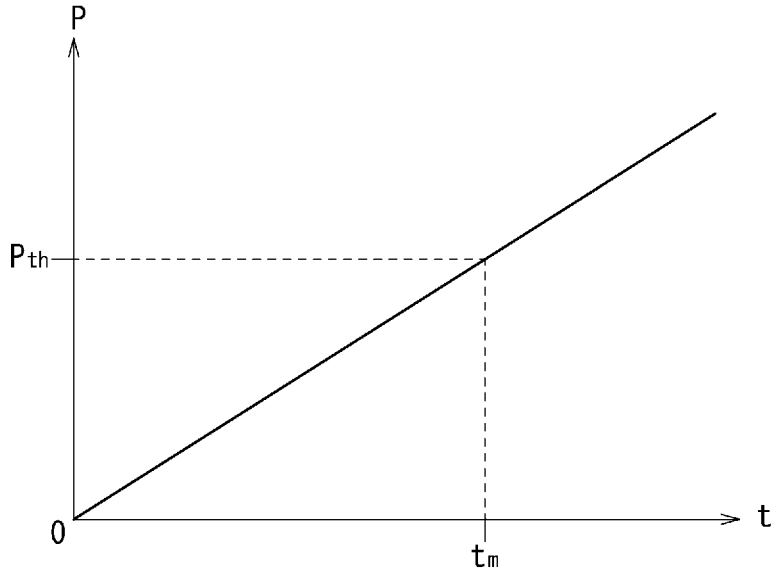
FIG. 6 illustrates the relationship between changes in pilot pressure in the first switching valve and switching timing during the working process in FIG. 5.

Moreover, during the working process, pilot air flows into the drive piston 22 of the first switching valve 20 via the first introduction path 21 and the second regulating valve 26 as indicated by an arrow A3 in FIG. 5. The pilot air flowing in the first introduction path 21 is regulated by the second regulating valve 26. As a result, the pressure of the pilot air in the piston chamber 54*a* gradually increases with the passage of time t as illustrated in FIG. 6. The first switching valve 20 is kept at the first position to which the first switching valve 20 is biased by the biasing member 24 until the piston 106 of the air cylinder 100 approaches a predetermined position in the vicinity of the stroke end. The pushing force of the drive piston 22 of the first switching valve 20 exceeds the biasing force of the biasing member 24 at a point $t_m$ in time when the pressure of the pilot air in the piston chamber 54*a* becomes greater than a predetermined pressure $P_{th}$. As a result, the first switching valve 20 is displaced to the second position.

Figure 7:
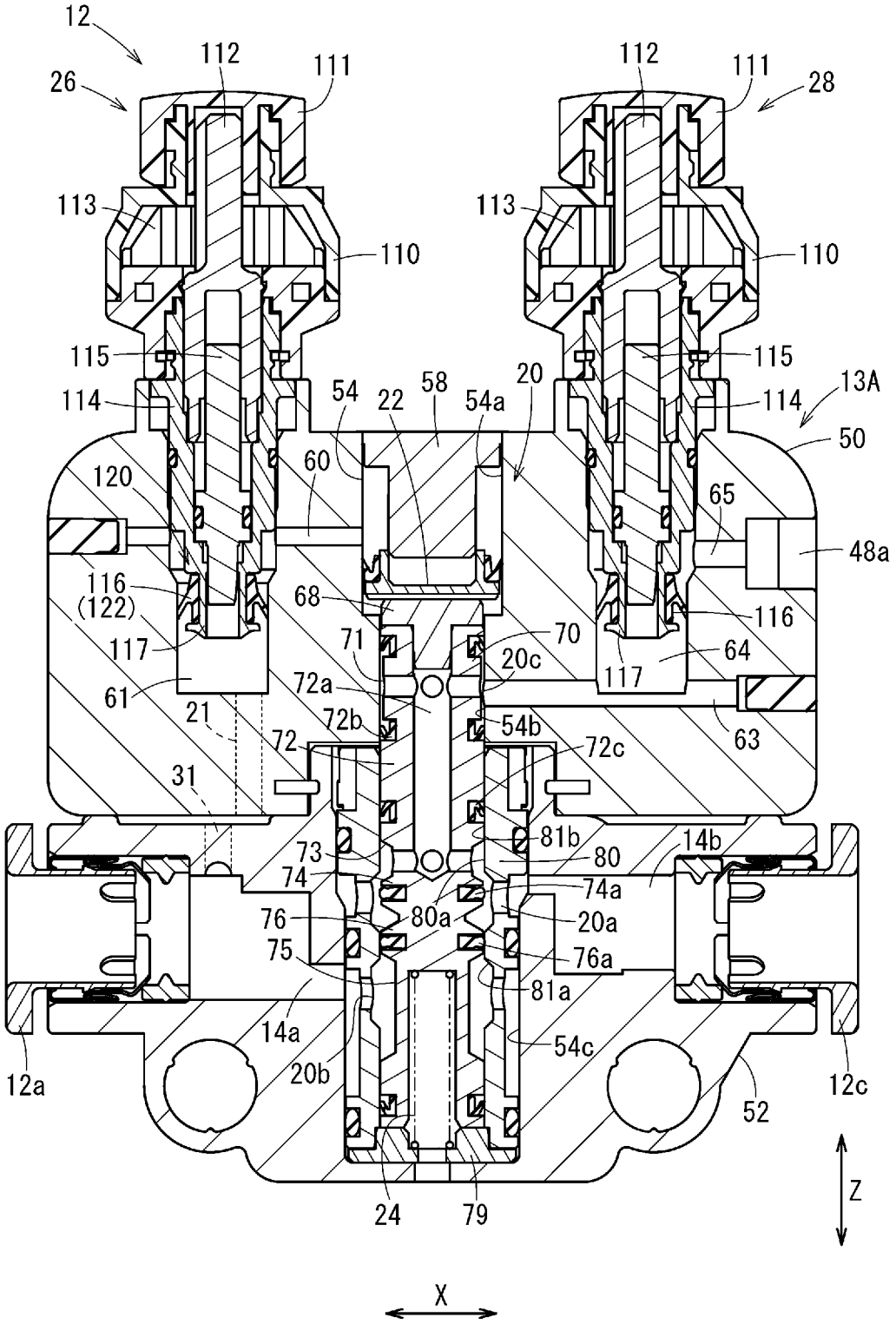
FIG. 7 is a cross-sectional view illustrating a state where the first switching valve in FIG. 3 moves to a second position.

As illustrated in FIG. 7, when the first switching valve 20 is at the second position, the spool 70 is located at the lower end. This causes the first connection portions 20*a* and the third connection portions 20*c* to communicate with each other. As indicated by a broken line arrow B5 in FIG. 8, the exhaust air in the channel 14*b* is exhausted from the air outlet 48*a* via the first regulating valve 28. The first regulating valve 28 further reduces the flow rate of exhaust air exhausted from the air cylinder 100 more than the speed controller 42 reduces the flow rate, to reduce the moving speed of the piston 106 in the vicinity of the stroke end of the air cylinder 100 to the second speed that is slower than the first speed. This can reduce impact on the air cylinder 100 at the stroke end.

Figure 9:
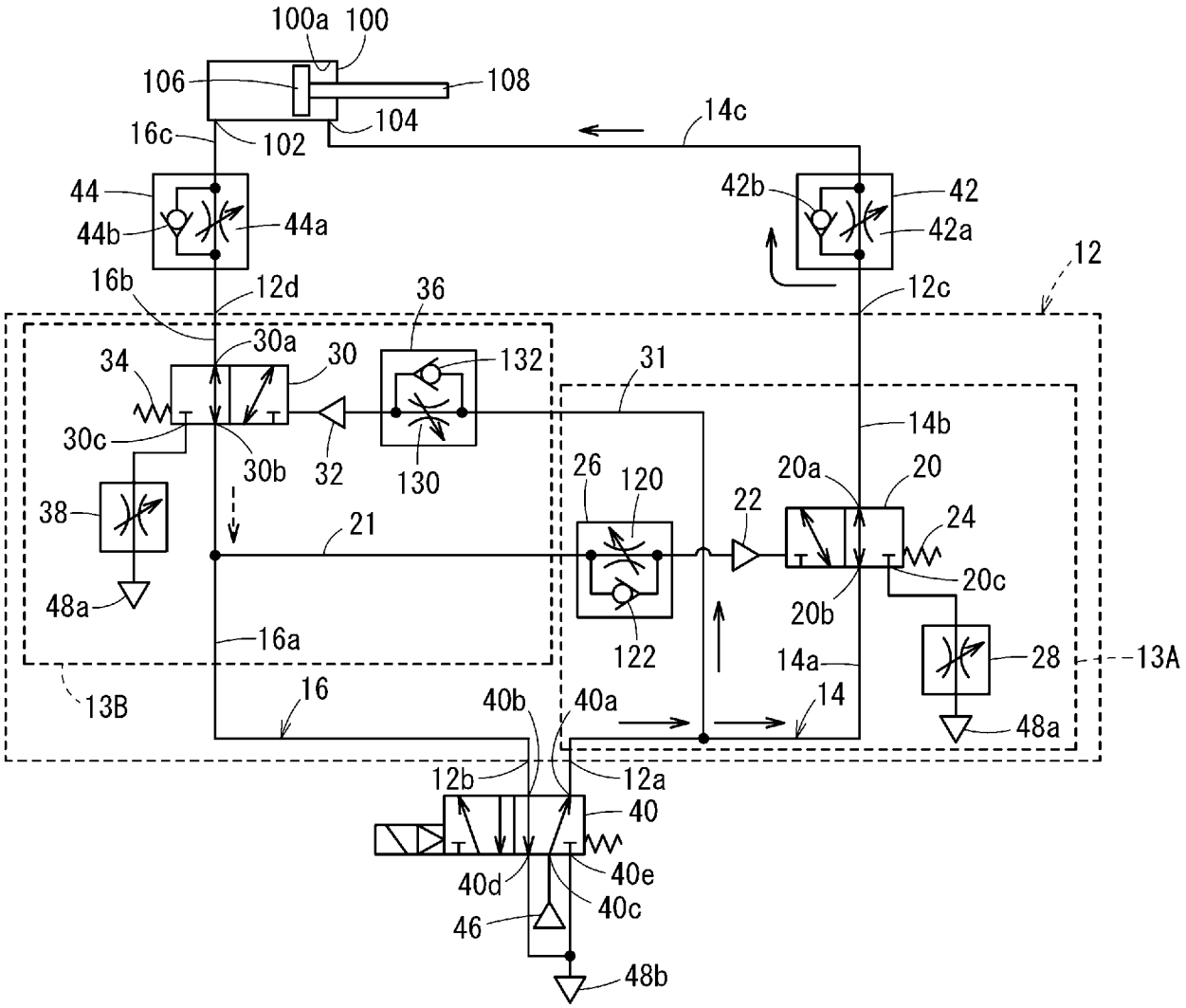
FIG. 9 is a fluid circuit diagram illustrating a connection state of the flow controller and the driving apparatus in FIG. 1 during a retracting process of the air cylinder.

Subsequently, the retracting process where the piston rod 108 of the air cylinder 100 is drawn in follows. As illustrated in FIG. 9, during the retracting process, the operation switching valve 40 is displaced to the first position to cause the high-pressure air supply source 46 to communicate with the first channel 14, and cause the air outlet 48*b* to communicate with the second channel 16. At this moment, the second channel 16 is exposed to the atmosphere via the air outlet 48*b*, and thus the pilot air in the first switching valve 20 is exhausted through the first introduction path 21 and the check valve 122 of the second regulating valve 26. The first switching valve 20 then returns to the first position by the biasing force of the biasing member 24. This causes the first connection portions 20*a* and the second connection portions 20*b* to communicate with each other. Subsequently, the high-pressure air of the high-pressure air supply source 46 is supplied to the rod-side part of the cylinder chamber 100*a* of the air cylinder 100 via the first channel 14.

During the retracting process, the flow rate of exhaust air exhausted from the air cylinder 100 is regulated by the speed controller 44 provided for the second channel 16. As a result, the piston rod 108 is drawn in at a predetermined speed (third speed) according to the degree of opening of the speed controller 44.

Moreover, during the retracting process, pilot air is supplied to the second switching valve 30 from the first channel 14 via the second introduction path 31. The pressure of the pilot air gradually increases at a predetermined speed according to the degree of opening of the fourth regulating valve 36 provided for the second introduction path 31. The pushing force of the drive piston 32 of the second switching valve 30 exceeds the biasing force of the biasing member 34 at a point in time when the pressure of the pilot air reaches a predetermined pressure, and thereby the second switching valve 30 is displaced to the second position. That is, the second switching valve 30 is displaced to the second position at a predetermined point in time when the piston 106 of the air cylinder 100 reaches the vicinity of the stroke end.

Figure 10:
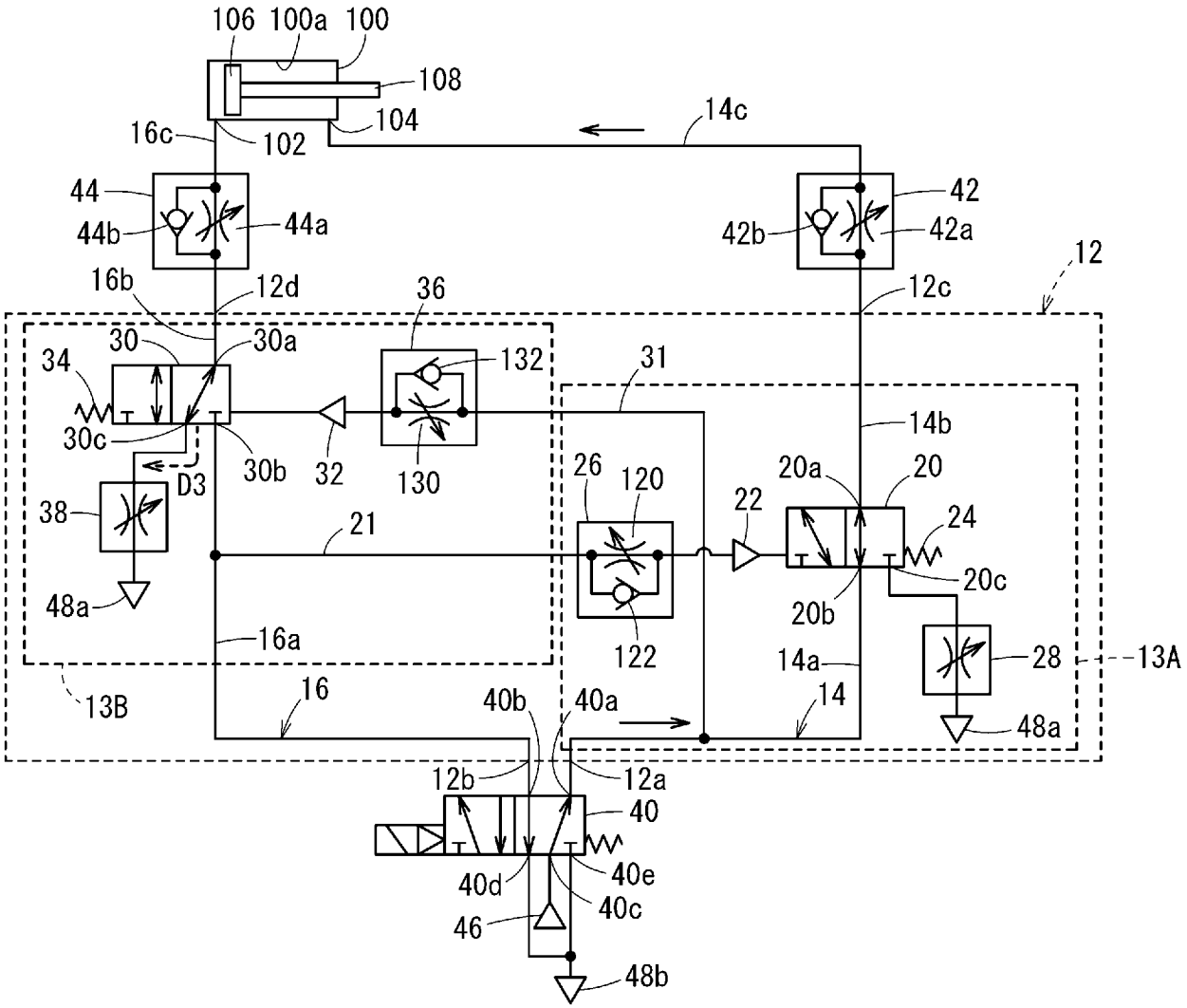
FIG. 10 is a fluid circuit diagram illustrating a connection state after a second switching valve moves to the second position during the retracting process in FIG. 9.

As a result, as illustrated in FIG. 10, the first connection portion 30*a* and the third connection portion 30*c* of the second switching valve 30 communicate with each other, and the exhaust air from the air cylinder 100 flows toward the third regulating valve 38 as indicated by an arrow D3. The air is then exhausted from the air outlet 48*a* via the third regulating valve 38. The third regulating valve 38 causes the piston 106 to be displaced at the fourth speed slower than the third speed by further reducing the flow rate of exhaust air more than the speed controller 44 reduces the flow rate. This controls the operating speed of the piston 106 at the stroke end during the retracting process, resulting in less impact on the air cylinder 100.

The flow controller 12 and the driving apparatus 10 according to this embodiment described above produce the following advantageous effects.

The flow controller 12 includes the first switching valve 20 configured to be displaced from the first position to the second position under the effect of pilot air, cause the rod-side port 104 of the air cylinder 100 to communicate with the first channel 14 at the first position, and cause the rod-side port 104 of the air cylinder 100 to communicate with the air outlet 48*a* via the first regulating valve 28 at the second position, the first introduction path 21 configured to guide the pilot air from the second channel 16 to the first switching valve 20, and the second regulating valve 26 provided for the first introduction path 21 and configured to adjust timing of displacement of the first switching valve 20 by regulating the flow rate of the pilot air.

According to the above-described structure, the pilot air is supplied to the second regulating valve 26 from the second channel 16 different from the channel provided with the first regulating valve 28 and the speed controller 42. This facilitates adjustment to operation of the flow controller 12 since the operation of the second regulating valve 26 is not affected by the degrees of opening of the first regulating valve 28 and the speed controller 42.

In the flow controller 12, the first regulating valve 28 may comprise a throttle valve configured to regulate the flow rate of air exhausted from the rod-side port 104 of the air cylinder 100. This controls the operating speed in the vicinity of the stroke end of the air cylinder 100, resulting in less impact at the stroke end.

The flow controller 12 may further include the second switching valve 30 configured to be displaced from the first position to the second position under the effect of pilot air, cause the head-side port 102 of the air cylinder 100 to communicate with the second channel 16 at the first position, and cause the head-side port 102 of the air cylinder 100 to communicate with the air outlet 48*a* via the third regulating valve 38 at the second position, the second introduction path 31 configured to guide the pilot air from the first channel 14 to the second switching valve 30, and the fourth regulating valve 36 provided for the second introduction path 31 and configured to adjust timing of displacement of the second switching valve 30 by regulating the flow rate of the pilot air.

According to the above-described structure, the operating speed at the stroke end can also be changed gradually during the retracting process of the air cylinder 100.

In the flow controller 12, the third regulating valve 38 may comprise a throttle valve reducing the flow rate of air exhausted from the head-side port 102 of the air cylinder 100. Thus, the operating speed in the vicinity of the stroke ends can be controlled during both the working process and the retracting process, and the impact at the stroke ends can be reduced.

In the flow controller 12, each of the first switching valve 20 and the second switching valve 30 may be displaced from the first position to the second position at a point in time when the pressure of the pilot air reaches or exceeds a predetermined value. Since the switching timing can be adjusted using the meter-in second regulating valve 26 and the meter-in fourth regulating valve 36, the flow controller 12 can be easily adjusted.

In the flow controller 12, each of the second regulating valve 26 and the fourth regulating valve 36 may comprise an variable throttle valve and may be provided with a graduated portion 113 indicating the degree of opening of the variable throttle valve. This facilitates adjustment to operation timing of the second regulating valve 26 and the fourth regulating valve 36.

In the flow controller 12, each of the first regulating valve 28 and the third regulating valve 38 may comprise an variable throttle valve or a fixed throttle valve.

In the flow controller 12, each of the first switching valve 20 and the second switching valve 30 may comprise a spool valve. This enables reliable switching operations using pilot air. In addition, sufficient cross-sectional areas can be secured to operate the air cylinder 100 at high speed.

The driving apparatus 10 of the air cylinder 100 according to this embodiment includes the flow controller 12, the high-pressure air supply source 46 configured to supply high-pressure air to the air cylinder 100 via the first channel 14 or the second channel 16, and the air outlet 48*b* configured to exhaust the air from the air cylinder 100 via the first channel 14 or the second channel 16. Thus, adjustment of the driving apparatus 10 can be simplified due to the flow controller 12.

The driving apparatus 10 may further include the operation switching valve 40 configured to switch between a first connection state where the first channel 14 communicates with the high-pressure air supply source 46 while the second channel 16 communicates with the air outlet 48*b* and a second connection state where the second channel 16 communicates with the high-pressure air supply source 46 while the first channel 14 communicates with the air outlet 48*b*.

The driving apparatus 10 may further includes the speed controller 42 (or 44) configured to reduce the flow rate of air in the first channel 14 and the second channel 16. Thus, the operating speed of the air cylinder 100 during the normal stroke before the first regulating valve 28 and the third regulating valve 38 regulate the operating speed, can be adjusted using the speed controllers 42 and 44.

The present invention has been described by taking a preferred embodiment as an example. However, the present invention is not limited in particular to the above-described embodiment, and various modifications can be made thereto without departing from the scope of the present invention as a matter of course.

The invention claimed is:

1. A flow controller that changes a flow rate of air supplied or exhausted through at least one of a first channel communicating with one port of an air cylinder and a second channel communicating with another port of the air cylinder in midstroke, comprising:

a first switching valve configured to be displaced from a first position to a second position under an effect of pilot air, cause the one port of the air cylinder to communicate with the first channel at the first position, and cause the one port of the air cylinder to communicate with an air outlet via a first regulating valve at the second position;

a first introduction path configured to guide the pilot air from the second channel to the first switching valve; and a second regulating valve provided for the first introduction path and configured to adjust timing of displacement of the first switching valve by regulating a flow rate of the pilot air.

2. The flow controller according to claim 1, wherein the first regulating valve comprises a throttle valve configured to regulate a flow rate of air exhausted from the one port of the air cylinder.

3. The flow controller according to claim 1, further comprising:

a second switching valve configured to be displaced from a first position to a second position under an effect of pilot air, cause the other port of the air cylinder to communicate with the second channel at the first position, and cause the other port of the air cylinder to communicate with the air outlet via a third regulating valve at the second position;

a second introduction path configured to guide the pilot air from the first channel to the second switching valve; and a fourth regulating valve provided for the second introduction path and configured to adjust timing of displacement of the second switching valve by regulating a flow rate of the pilot air.

4. The flow controller according to claim 3, wherein the third regulating valve comprises a throttle valve reducing a flow rate of air exhausted from the other port of the air cylinder.

5. The flow controller according to claim 4, wherein each of the first switching valve and the second switching valve is displaced from the first position to the second position at a point in time when a pressure of the pilot air reaches or exceeds a predetermined value.

6. The flow controller according to claim 4, wherein each of the second regulating valve and the fourth regulating valve comprises a variable throttle valve and is provided with a graduated portion indicating a degree of opening of the variable throttle valve.

7. The flow controller according to claim 4, wherein each of the first regulating valve and the third regulating valve comprises a variable throttle valve or a fixed throttle valve.

8. The flow controller according to claim 4, wherein each of the first switching valve and the second switching valve comprises a spool valve.

9. A driving apparatus, comprising:

the flow controller according to claim 1;

a high-pressure air supply source configured to supply high pressure air to the air cylinder via the first channel or the second channel; and an air outlet configured to exhaust air from the air cylinder via the first channel or the second channel.

10. The driving apparatus according to claim 9, further comprising:

an operation switching valve configured to switch between a first connection state where the first channel communicates with the high-pressure air supply source while the second channel communicates with the air outlet and a second connection state where the second channel communicates with the high-pressure air supply source while the first channel communicates with the air outlet.

11. The driving apparatus according to claim 9, further comprising:

a speed controller configured to reduce a flow rate of air in the first channel and the second channel.

* * * * *